US005233804A

United States Patent [19]

Miller

[11] Patent Number: 5,233,804

[45] Date of Patent: Aug. 10, 1993

[54] CORNER PROTECTOR ASSEMBLY AND RETAINER CLIP THEREFOR

[76] Inventor: Donald W. Miller, 17W708 Butterfield Rd., Oak Brook, Ill. 60181

[21] Appl. No.: 722,096

[22] Filed: Jun. 27, 1991

[51] Int. Cl.[5] ..... E04B 5/00

[52] U.S. Cl. ..... 52/288; 52/254

[58] Field of Search ..... 52/288, 254, 287, 255, 52/232, 718; 403/403, 402, 401, 23

[56] References Cited

U.S. PATENT DOCUMENTS

| | | | |
|---|---|---|---|
| 1,229,765 | 6/1917 | Lehman . | |
| 2,681,716 | 6/1954 | Black | 189/88 |
| 3,001,330 | 9/1961 | Czaplicke | 50/166 |
| 3,016,590 | 1/1962 | Shanok et al. | 24/73 |
| 3,255,561 | 6/1966 | Cable | 52/288 |
| 3,298,147 | 1/1967 | Haberman | 52/287 |
| 3,405,488 | 10/1968 | Nelson | 52/287 |
| 3,559,356 | 2/1971 | Koral | 52/254 |
| 3,606,431 | 9/1971 | Kunevicius . | |
| 3,606,433 | 9/1971 | Kunevicius . | |
| 3,712,003 | 1/1973 | Hallock et al. | 52/254 |
| 3,717,968 | 2/1973 | Olsen et al. | 52/288 |
| 3,742,668 | 7/1973 | Oliver | 52/288 |
| 3,797,185 | 3/1974 | LaBorde | 52/288 |
| 3,825,229 | 7/1974 | Bartlett et al. | 256/59 |
| 3,861,110 | 1/1975 | Bartlett | 52/718 |
| 3,922,408 | 11/1975 | Smith | 428/40 |
| 3,991,537 | 11/1976 | Brown | 52/717 |
| 4,014,146 | 3/1977 | Di Mascio et al. | 52/211 |
| 4,104,839 | 8/1978 | Balzer et al. | 52/288 |
| 4,129,971 | 12/1978 | Reusser | 52/288 |
| 4,161,853 | 7/1979 | Weiss et al. | 52/288 |
| 4,189,885 | 2/1980 | Fritz | 52/287 |
| 4,196,552 | 4/1980 | Bartlett | 52/309.1 |
| 4,204,376 | 5/1980 | Calvert | 52/309.1 |
| 4,430,833 | 2/1984 | Balzer et al. | 52/255 |
| 4,569,171 | 2/1986 | Kuhr et al. | 52/242 |
| 4,642,957 | 2/1987 | Edwards | 52/242 |
| 4,706,426 | 11/1987 | Rumsey | 52/232 |
| 4,817,902 | 4/1989 | Mason | 52/288 |
| 4,903,449 | 2/1990 | Ellingson, Jr. | 52/288 |
| 4,999,961 | 3/1991 | McNary | 52/288 |
| 5,076,736 | 12/1991 | Grewe et al. | 403/402 |

*Primary Examiner*—Carl D. Friedman
*Assistant Examiner*—Winnie Yip
*Attorney, Agent, or Firm*—Lockwood, Alex, FitzGibbon & Cummings

[57] ABSTRACT

A protector assembly for corners includes a cover member applied to the corner so that it engages several retainer clips fastened to the wall. The retainer clips have outwardly extending tang portions adapted to engage the cover member, and further include deformation reduction means in the form of slots in the body portions thereof which substantially reduce any tendency of the retainer clips to extend away from the wall surface.

18 Claims, 2 Drawing Sheets

CORNER PROTECTOR ASSEMBLY AND RETAINER CLIP THEREFOR

BACKGROUND AND SUMMARY OF THE INVENTION

The present invention is directed to a protector assembly and, more particularly, to an assembly for protecting corners.

Corner protector devices are well-known in the art and typically employ a protective member which is secured to the corner surfaces by either adhesive means or by fasteners. These prior devices have several disadvantages. One disadvantage for adhesively mounted corner protectors is that an impact on the protective member may impart a sufficiently large force which overcomes the adhesive force between the wall and the corner member such that it moves out of place on the corner. The adhesives used sometimes deteriorate over time. Also, adhesively mounted systems cannot be easily removed once installed. A further disadvantage is the difficulty sometimes encountered in selecting the correct adhesive for a given application.

Another prior arrangement for protecting corners uses visible fasteners which pass through an opening in a protective member to fasten the member to the corner. These systems suffer several disadvantages. The exposed fasteners may present an unattractive appearance. Two other disadvantages are the requirement of either preplacement of drill holes in the wall corner for receiving the fasteners or holding the member in place while holes are drilled in the wall corner. Another disadvantage is the difficulty, especially when the member extends the entire height of the corner, in holding the member in place while the fasteners are applied.

Other corner protection arrangements utilize a member which is supported by one or more retainer clips or brackets which are fastened to the corner and which are concealed from view by the cover member. Typically, these clips or brackets engage open end portions of the cover member to support the cover member. These protector arrangements also suffer from several inherent disadvantages. Where the clips are non-resilient, such as an aluminum extrusion or stamping, it is very difficult to engage the cover member on the retainer clips without sliding the cover member carefully along the corner to ensure that the non-resilient clips engage the appropriate cover member engagement surfaces and thus the cover member must be made in sections, rather than in one-piece, to allow the proper installation thereof. Where the clips are made of a resilient material, such as spring steel, care must be taken when fastening the resilient clip to the wall surface, because overtightening or overdriving the fastener causes the clip to deform or flex outwardly from the wall surface. Because the retainer clip holds the cover member in place, the cover member consequently also flexes outwardly from the wall surface, leaving an unsightly appearance. The edges of the cover member then extend away from the wall which increases the possibility that clothing or an object may catch on the edge and cause the inadvertent removal of the same. If the outward flexure of the retainer becomes too pronounced, the retainer clip may not properly engage the cover member.

The present invention is therefore directed to a corner protector assembly which overcomes the aforementioned disadvantages. The corner protector assembly of the present invention substantially eliminates the likelihood of occurrence of flexure of the clip when it is fastened to the underlying wall so that the cover member is consistently engaged in a secure fashion. This is accomplished by providing an elongated corner member having inturned edges at its free ends which engage free ends of a retainer clip fastened to the corner wall. The retainer clip has an opening disposed in its wall engaging portions which interrupts the transmission of any flexural forces to keep them from acting on the retainer clip to flex it outwardly from the corner surfaces. Additionally, the present invention includes a retainer clip which substantially prevents sliding of the cover member, when installed, in an upward or downward direction.

Accordingly, it is a general object of the present invention to provide an improved corner protector assembly having an outer cover member which engages one or more resilient retainer clips affixed to the corner by fasteners in which the likelihood of the retainer clips flexing outwardly and away from the corner is substantially reduced.

Another object of the present invention is to provide an assembly for protecting corners in which the assembly includes a cover member which is applied to the corner and several retainer clips which are fastened to the wall, the retainer clips having outwardly extending tang portions which are adapted to engage the cover member and which retainer clips include deformation reduction means which substantially reduces any tendency of the retainer clips to extend away from the wall surface because of tightening of the fasteners during installation.

Still another object of the present invention is to provide an improved retainer clip for use with a corner protector assembly, wherein the retainer clip has two leg portions which angularly intersect at an apex of the clip, the leg portions having outwardly extending tang portions at the outboard ends thereof, the leg portions further having flexure reduction means in the form of lateral slots disposed between the tang portions and fasteners, the slots substantially preventing the retainer clip leg portions from separating away from the wall surfaces to which they are attached.

Yet another object of the present invention is to provide a corner protection system which includes an elongated cover member, a plurality of cover member retaining means in the form of angled clip members, each of the clip members having two wall engaging portions and cover member engaging portions, the wall engaging portions each including a transverse slot or similar opening disposed therein adjacent to a fastener therefor and between the fastener and the cover member engaging portions.

These and other objects, features and advantages of the present invention will be more clearly understood upon consideration of the detailed description of the preferred embodiments of the invention which will be described to follow.

BRIEF DESCRIPTION OF THE DRAWINGS

In the course of this description, reference will frequently be made to the attached drawings in which.

DESCRIPTION OF THE PREFERRED EMBODIMENTS

Figure 1:
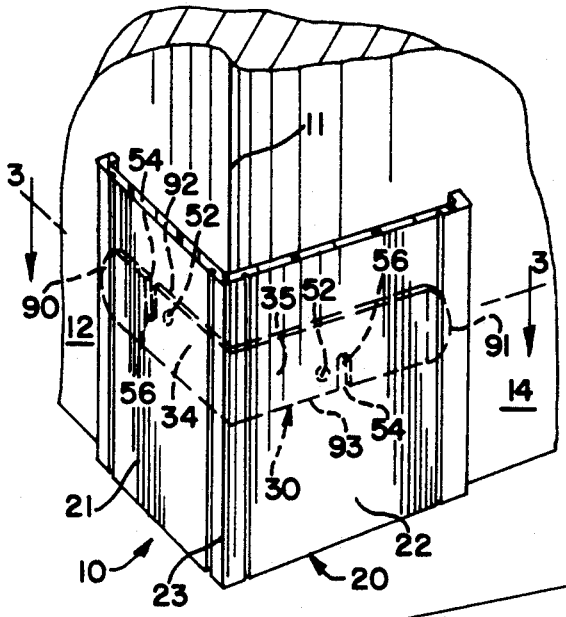
FIG. 1 is a perspective view of a corner protector assembly constructed in accordance with the principles of the present invention and in which the corner protector assembly is shown in combination with a wall corner.

A first embodiment of a corner protector assembly 10 constructed in accordance with the principles of the present invention for mounting on corner surfaces is illustrated in FIG. 1, wherein the protector assembly 10 is shown installed on a wall corner 11 defined by the intersection of two exterior wall surfaces 12 and 14.

The corner protector assembly 10 may be used on corners formed from plaster, sheetrock walls, prefabricated partitions, brick, concrete block, wood paneling and the like, as well as any other suitable building material. Provided that the underlying surface or structure is one to which the retainer clips 30 can be attached, the present invention can be used on virtually any type of wall construction.

Returning to FIGS. 1 and 2, the corner protector assembly 10 includes an exterior cover member 20 which engages one or more retaining means, shown as retainer clips 30. The clip 30 is attached to the wall surfaces 12, 14 by way of any suitable fastener means, shown as mounting screws 40. The clip 30, at its outermost ends 80, engages inturned ends 24, shown as abutments or shoulders 26, which define two respective clip engaging surfaces 27 within the cover member 20.

Figure 3:
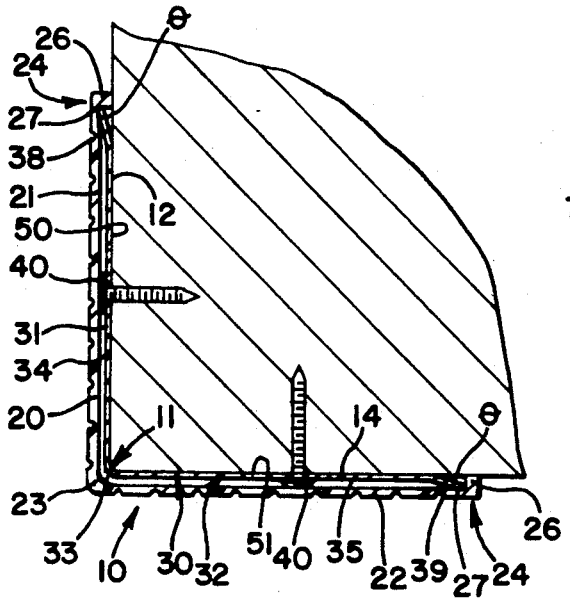
FIG. 3 is a cross-sectional view of the corner protector assembly of FIG. 1 taken along line 3—3.

The cover member 20 is preferably formed from a durable material, such as plastic or metal, and may extend for substantially the entire extent, or height, or for a preselected extent of the corner 11. In this regard, the cover member 20 is defined by two generally planar wall surface protection or covering portions 21, 22 which intersect at their innermost ends to form a corner 23 which has generally the same angle as that of the wall corner 11. At its outermost ends and as mentioned above, the cover member 20 has a pair of inturned edges 24 which extend inwardly to define a pair of shoulders 26, each shoulder having a clip engaging surface 27 disposed thereon against which the retainer clip ends 80 bear. (FIG. 3.)

Figure 2:
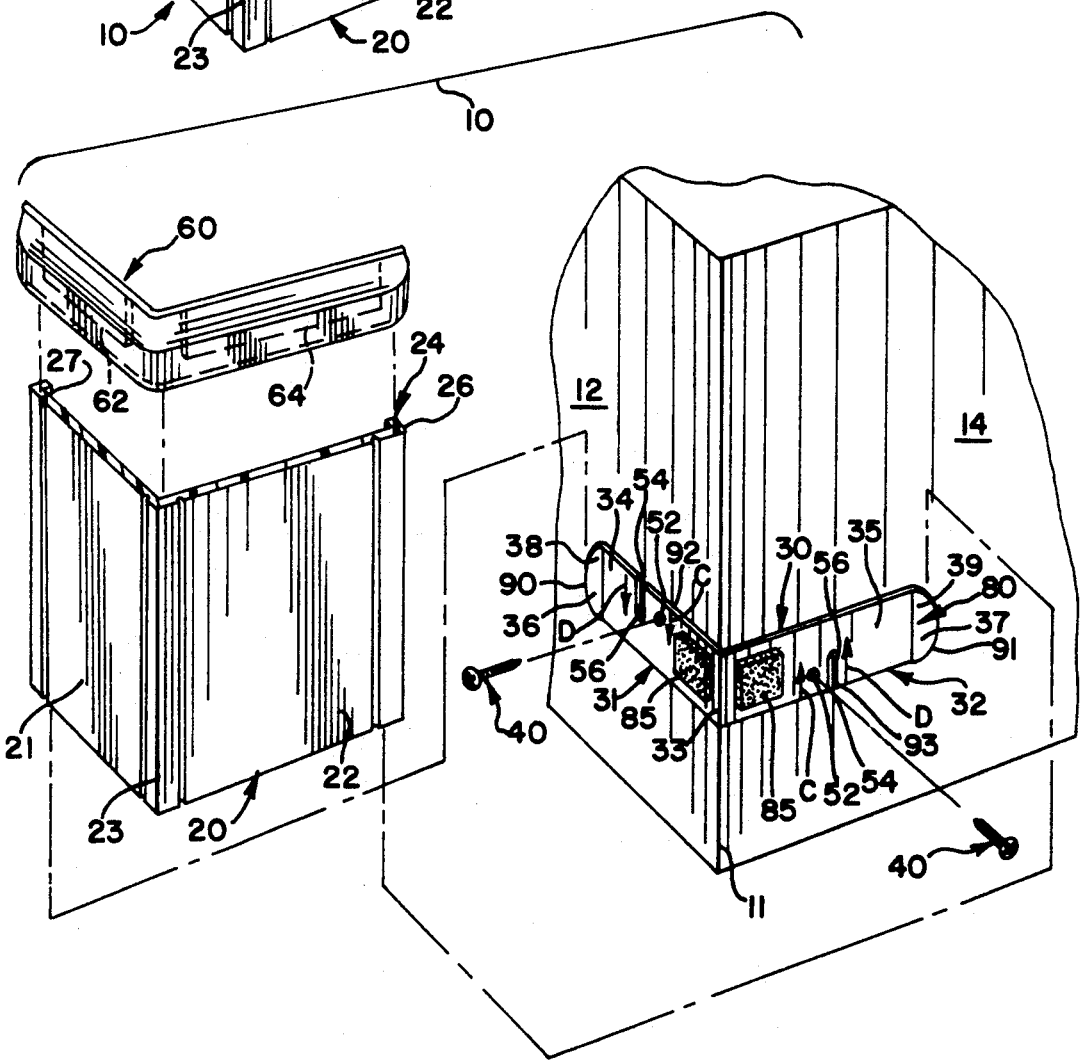
FIG. 2 is an exploded perspective view of the arrangement in accordance with FIG. 1, additionally including an end cap member.

Turning now to the details of the retainer clip 30, and in particular FIG. 2, it can be seen that the retainer clip 30 forms an angled member which angle approximates the wall corner 11 formed by the wall surfaces 12 and 14. In this regard, the retainer clip 30 includes two laterally extending leg portions 31, 32 which are bent along a central apex 33 of the clip 30 to define its desired angle. Each of the clip leg portions 31, 32 have separate wall engaging portions 34 and 35 and cover engaging portions 36,37. The cover member engaging portions 36,37 include tangs 38 and 39 which extend outwardly from the plane of the wall engaging portions defined by the clip leg portions 31 and 32, preferably having a general angle $\phi$ of about 35°. As shown in FIGS. 1 and 2, these tangs 38 and 39 have generally curved end faces or profiles 90 and 91. As will be discussed later, these tangs 38 and 39 engage the clip engaging surfaces 27 of the cover member 20.

The wall engaging portions 34, 35 include interior wall engagement surfaces 50, 51 which are generally planar and which face the wall corner 11. They are supported flush against the corner wall surfaces 12 and 14 by mounting screws 40. The wall engaging portions 34, 35 of the clip 30 include apertures or openings 52 which accommodate the mounting screws 40. Adhesive means in the form of double-faced pads 85 may be applied to the clip leg portions 31, 32, which pads 85 provide additional retention capability, especially in a vertical plane, to the clip 30.

The retainer clips 30 have a slightly smaller width than the cover member 20 and thus it and the fasteners 40 associated therewith are housed within the cover member 20 and are entirely concealed from view, thus presenting an attractive appearance, despite fully exterior mounting of the arrangement upon the finished wall.

In an important aspect of the present invention, the retainer clip 30 is provided with means for reducing any substantial deformation imparted to the clip 30 during the mounting process. As noted above, the retainer clip 30 and its two extending wall engagement surfaces 50, 51 are intended to be mounted flush against the outer surface of the corner wall surfaces 12 and 14.

Figure 4:
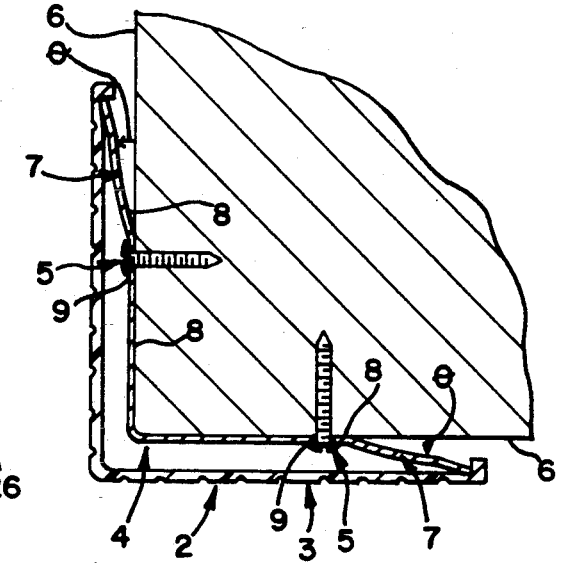
FIG. 4 PRIOR ART
FIG. 4 is a cross-sectional view of a corner protector assembly representative of the prior art wherein the retainer clip has no flexure reduction means.

As shown best in FIG. 4 (a cross-sectional view of a conventional corner protector assembly 2 having a cover member 3 and a retainer clip 4), when assembly fasteners 5 are tightened or driven into underlying wall surface 6, there is a tendency for the retainer clip ends 7 to "spring" or flex outwardly away from the wall surface so that the wall engaging portions 8 of the clip 4 extend outwardly away from the wall at an angle $\theta$. When so flexed as in FIG. 4, the cover member 3 fails to mount substantially flush of the wall 6, which detracts from the appearance thereof. Additionally, because the ends of the cover member 3 project outwardly, someone or something passing the cover member 3 may catch the ends thereof and pull it off its mounting. This flexing tendency is seen mostly in inherently resilient retainer clips such as those stamped from a spring steel or molded from a plastic. This flexure occurs because the fastener 5 forces the wall engaging portions 8 into flush contact with the corner walls 6 only around the fastener opening 9, the head of the fastener thereby imparting a localized compressive force therearound. The natural reaction of a resilient material is to flex outwardly (or away from the wall surface) at the end 7 of the clip 4. This tendency of the clip 4 to spring outwardly is even more exaggerated when the fastener 5 is overtightened, thereby increasing the angle $\theta$.

Overtightening of the fasteners 5 into the underlying wall 6 may cause severe or permanent deformation such as dimpling to occur in the wall engaging portions 8 of the clip 4, which deformation results in distortion or flexing of the clip wall engaging portions 8 which leaves a gap between the clip 4 and the wall. If the outward flexure of the clip wall engaging portions 8 becomes too pronounced, the clip 4 may fail to engage the cover member 3.

The present invention avoids this problem by flexure reduction means in the form of an opening 54, shown as a slot 56, which extends transversely from either of a first or second edge 92 or 93, respectively, of the clip 30 into the bodies, of the two wall engaging portions 34,35. Preferably, these slots 56 are disposed adjacent the fastener openings 52 between the openings 52 and the outermost tangs 38,39. These slots 56 extend down into the body of the wall engaging portions 34,35 a depth D, which is equal to or greater than the distance C, which is the distance from the clip edges 92,93 to the centerline of the fastener openings 52. Preferably as shown in FIGS. 1 and 2, the wall engaging portion 34 has one slot 56 extending therein from a first edge 92 and the second wall engaging portion 35 has a second slot 56 extending therein from the second and opposite edge 93.

These slots 56 extend well into the area wherein flexure occurs due to tightening of the mounting screws 40. Thus, if the screws 40 are overtightened, any dimpling that results which ordinarily causes the clip ends 80 to flex away from the wall surfaces 12, 14 transmits a flexural force along the wall engaging portions 34,35 toward the ends of the same. This flexural force is interrupted by the slots 56.

In installation, the cover member 20 is applied to the retainer clip 30 after the proper number of retainer clips 30 have been fastened to the wall. One of the cover abutments or shoulders 26 of the cover 20 is engaged with one of the clip ends 38 and the central portions 23 of the cover 20 is then forced inwardly toward the wall to allow shoulder 26 to engage the remaining clip end 39 to snap the cover into place on the wall. Thus, the cover 20 is easily and quickly applied to the retainer clip 30.

As shown in FIG. 2, the protector assembly 10 may also include an end molding or cap 60 which is mated to the longitudinal ends of the cover member 20 by way of channels 62 and 64.

Figure 5:
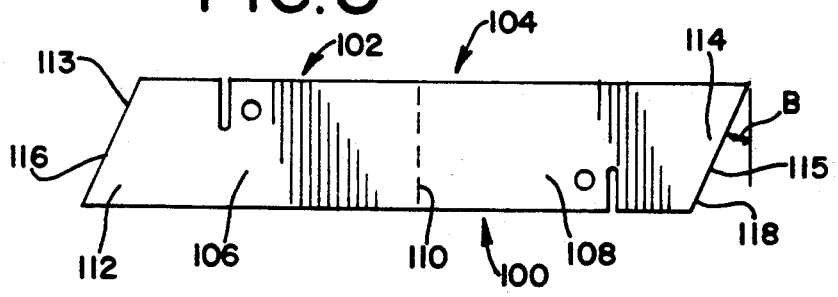
FIG. 5 is a plan view of a second embodiment of a retainer clip for a corner protector assembly constructed in accordance with the principles of the present invention.
Figure 6:
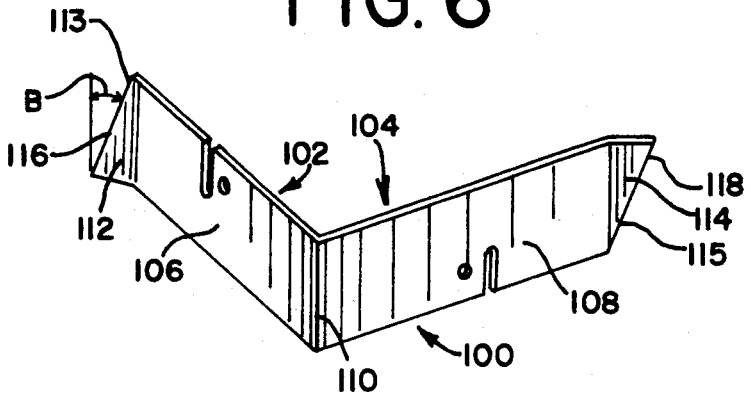
FIG. 6 is a perspective view of the retainer clip of FIG. 5.

A second embodiment of a retainer clip 100 constructed in accordance with the principles of the present invention is shown in FIGS. 5 and 6. The retainer clip 100 has angularly extending legs 102, 104, each of which include a wall engaging portion 106, 108 extending from the apex 110 of the Clip 100 up to a cover engaging portion 112, 114. The cover engaging portions 112, 114, are bent slightly outwardly from the wall engaging portions 106, 108 and include, at their respective outermost edges 113, 115, angled surfaces 116, 118 having a general angle of about 15°. As seen best in FIG. 6, these angled surfaces are reversed with respect to each other, that is, one surface 116 is angled downwardly while the other 118 is angled upwardly such that they extend in opposite directions. In such a construction, the angled surfaces 116, 118 serve to "bite" into the internal edges of the cover member 20 and thereby prevent the cover member 20 from sliding on the retainer clips 100.

It will be understood that the embodiments of the invention which have been described are merely illustrative of the principles of the present invention. Numerous modifications may be made by those skilled in the art without departing from the true spirit and scope of the invention.

I claim:

1. A corner protector assembly adapted to be secured to a corner defined by the intersection of two walls, the corner protector assembly comprising, in combination:

an elongated cover member having a generally angular configuration which is complimentary to the corner to which it is applied, the cover member having two leg portions joined together at an apex thereof, each of the leg portions having an inturned shoulder portion which defines a surface of said cover member which engages a retaining member;

said retaining member being adapted to be affixed to said corner, the retaining member including an angled clip having two laterally extending leg portions angularly disposed with respect to each other, the two slip leg portions joined together at an apex of said clip, each of said two leg portions further having a wall engaging portion extending from said clip apex to a cover member engaging portion, said wall engaging portions being adapted to be secured to said corner by at least one fastener extending through a fastener opening disposed in an associated body portion of said wall engaging portion, said cover member engaging portions extending angularly outward with respect to said wall engaging portions and being adapted to engage said shoulder portions of said cover member, means for reducing flexure in said wall engaging portions of said retaining member the flexure reduction means including a slot disposed in each of said retaining clip two leg portions adjacently outwardly of said fastener opening, said slots extending into said wall engaging portion body portions for a first predetermined distance which is at least equal to a second predetermined distance between an edge of said clip and said fastener opening, whereby the tendency of said retainer clip leg portions to flex outwardly from said corner when said fastener secures said retaining member to said corner is substantially eliminated.

2. The corner protector assembly of claim 1, wherein each of said clip two wall engaging portions have respective first and second edges, one of said clip two wall engaging portions having a first clip slot extending therein from a first edge associated therewith, the other of said clip two wall engaging portions having a second clip slot extending therein from a second edge associated therewith.

3. The corner protector assembly of claim 1, wherein said first predetermined distance is greater than said second predetermined distance.

4. The corner protector assembly of claim 1, wherein said first predetermined distance is equal to said second predetermined distance.

5. The corner protector assembly of claim 1, wherein said slots of said one and other of said clip two wall engaging portions extend therein in opposite directions.

6. The corner protector assembly of claim 1, wherein said retainer clip cover member engaging portions include tangs having generally arcuate end profiles.

7. The corner protector assembly of claim 1, wherein said retainer clip cover member engaging portions include tangs having generally angular end profiles.

8. The corner protector assembly of claim 7, wherein said retainer clip tang angular end profiles extend in opposite directions.

9. The corner protector assembly of claim 1, further including an angled end member having two leg portions angularly disposed with respect to each other, the end member having at least one channel which engages an end of said cover member.

10. The corner protector assembly of claim 1, further including adhesive means disposed on said retainer clip, the adhesive means providing adhesive contact between said retainer clip and said cover member.

11. A protective assembly for securement to a corner formed by the intersection of two planar wall surfaces, the protective assembly comprising:

an elongated corner cover for protecting the corner area, said cover having inturned longitudinally extending shoulders defining notches at free ends of the corner cover, the notches being adapted to engage an end of a retaining means;

means for retaining said corner cover in place upon the corner, the retaining means including a plurality at resilient clips securing said corner cover to said corner, each clip having an angular configuration defining two legs extending outwardly from an apex of said clip, each of said legs including a wall engaging portion and a corner cover engaging portion, the wall engaging portion having a generally planar wall engagement surface disposed on an inner portion thereof, said wall engaging portion including an opening disposed therein between two generally parallel edges of said wall engaging portion, the opening permitting the passage therethrough of a fastener into said corner to fasten said clip to said corner;

slot means disposed in each of said clip legs outwardly of said fastener openings and inwardly of said corner cover engaging portions, said fastener openings being further spaced a first predetermined distance between said generally parallel edges of said wall engaging portions, said slot means further extending into the wall engaging portion of said retainer clip leg for a second predetermined distance which is at least equal to said first predetermined distance, the slot means substantially reducing any flexure imparted to said clip legs by fasteners used to attache said retaining means to a wall structure, whereby flexure of said clip wall engaging portions and said corner cover is reduced.

12. The protective assembly of claim 11, wherein said clip cover engaging portions have generally arcuate end faces.

13. The protective assembly of claim 11, wherein said retainer clip cover engaging portions have angular end faces.

14. The protective assembly of claim 13, wherein said retainer clip cover engaging portion end faces are oppositely directed with respect to each other.

15. The protective assembly of claim 11, wherein said second predetermined distance is greater than said first predetermined distance.

16. The protective assembly of claim 11, wherein said slot means interrupts said wall engaging portion.

17. In a combination for a corner protection system for protecting a corner by securing an elongated cover member to the corner, said combination including a cover member and a plurality of clips which retain the cover member in place upon the corner, the combination comprising:

an elongated cover member having two generally planar covering portions joined together at a central point thereof to define an angled member, the corner member having shoulder portions which provide cover member engagement surfaces which are engaged by a plurality of retainer clips; and at least one of said plurality of retainer clips when attached to the corner, providing a means for retaining said cover member in place, each of said one of the retainer clips including two elongated leg portions joined at an apex thereof and extending outwardly therefrom to define a predetermined angle at least one of said retainer clip two leg portions including a point of attachment to said corner by a fastener, said one of said retainer clips further including end portions which engage said corner member engagement surfaces, said one of said retainer clip leg portions further including a discontinuity extending into the leg portion, the discontinuity being disposed adjacent said fastener point of attachment and between said point of attachment and said leg end portion, said discontinuity substantially reducing flexure of said leg portion when the fastener is applied to said leg portion at said point of attachment.

18. A corner protector assembly adapted to be secured to a corner defined by the intersection of two walls, the corner protector assembly comprising, in combination:

a cover member having a generally angular configuration complimentary to the corner, the cover member having two leg portions joined together at an apex thereof, each of the cover member leg portions having a shoulder portion which defines a surface of said cover member which engages a retaining member;

said retaining member being adapted to be affixed to said corner, the retaining member including an angled clip having two leg portions angularly disposed with respect to each other, the two leg portions being joined together at an apex of said clip, each of said two leg portions further having a wall engaging portion extending from said clip apex to a cover member engaging portion of said clip, said wall engaging portions having at least one fastener opening disposed in a body portion of said wall engaging portion, the fastener opening receiving a fastener therethrough when said corner protector assembly is secured to said corner, said cover member engaging portions extending angularly outward with respect to said wall engaging portions and each being adapted to engage said shoulder portions of said cover member, means for reducing flexure in said wall engaging portions of said retaining member, the flexure reduction means including at least one opening in each of said retainer clip leg portions extending from an edge of said clip leg portion into said wall engaging portion body for a distance which is at least equal to a distance between an edge of said clip and said fastener opening, whereby the tendency of said retainer two leg portions to flex outwardly from said cover member when said fastener secures said retaining member to said corner is substantially eliminated.

* * * * *